US005289882A

United States Patent [19]

Moore

[11] Patent Number: 5,289,882

[45] Date of Patent: Mar. 1, 1994

[54] SEALED ELECTRICAL CONDUCTOR METHOD AND ARRANGEMENT FOR USE WITH A WELL BORE IN HAZARDOUS AREAS

[75] Inventor: Boyd B. Moore, 427 Mignon, Houston, Tex. 77024

[73] Assignee: Boyd B. Moore, Houston, Tex.

[21] Appl. No.: 651,633

[22] Filed: Feb. 6, 1991

[51] Int. Cl.[5] ..... E21B 33/03

[52] U.S. Cl. ..... 166/379; 166/65.1; 166/75.1; 439/198; 439/204

[58] Field of Search ..... 166/65.1, 75.1, 379; 439/206, 191, 194, 192, 198, 199, 936, 204

[56] References Cited

U.S. PATENT DOCUMENTS

| | | | |
|---|---|---|---|
| 3,638,732 | 2/1972 | Huntsinger et al. | 166/65.1 X |
| 4,117,287 | 9/1978 | Walker et al. | 439/191 X |
| 4,154,302 | 5/1979 | Cugini | 166/65.1 X |
| 4,289,199 | 9/1981 | McGee | 166/65.1 |
| 4,416,495 | 11/1983 | Regan | 439/192 |
| 4,627,490 | 12/1986 | Moore | 166/65.1 |
| 4,708,201 | 11/1987 | Reed | 166/65.1 |

OTHER PUBLICATIONS

The National Electric Code Handbook Based on the 1990 Edition of the National Electrical Code pp. 659–699.

*Primary Examiner*—Hoang G. Dang

*Attorney, Agent, or Firm*—Pravel, Hewitt, Kimball & Krieger

[57] ABSTRACT

An arrangement to conduct electrical power from a non-hazardous area through plural electrical conductors to the electrical conductor of a power cable which extend through a sealed barrier in a wellhead in a hazardous area including a rigid conduit with a power source electrical conductor therein extending into the hazardous area from an adjacent non-hazardous area for conducting electrical power to a downhole electrical conductor in the hazardous area, said rigid conduit including a seal fitting, splice fitting connected with said seal fitting and positioned adjacent the wellhead for receiving the ends of the power source electrical conductor and the ends of the downhole electrical conductor extend through the sealed barrier in the wellhead for splicing them together. The seal fitting includes a seal within 18 inches downstream of the splice fitting and also includes a breather for discharge of fluid and for inhibiting an internal explosion, flame or fire within the arrangement from exiting into the hazardous area.

17 Claims, 4 Drawing Sheets

FIG. 4
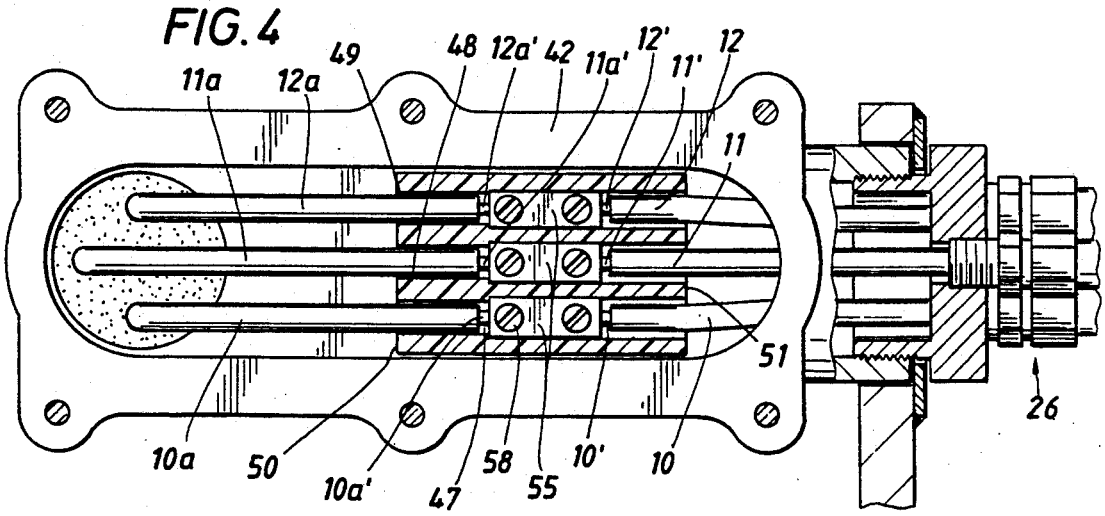
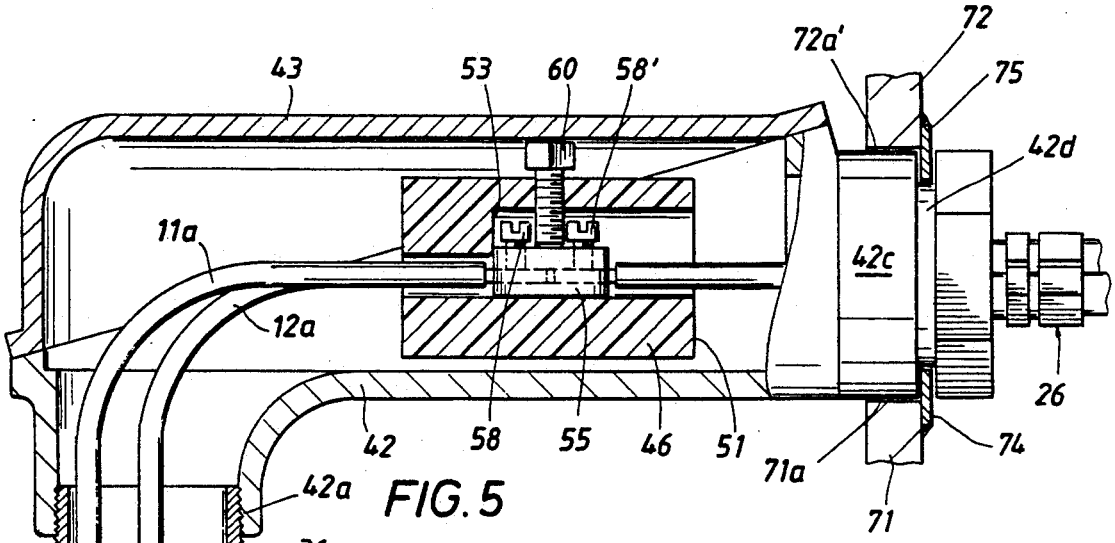
FIG. 5
FIG. 6
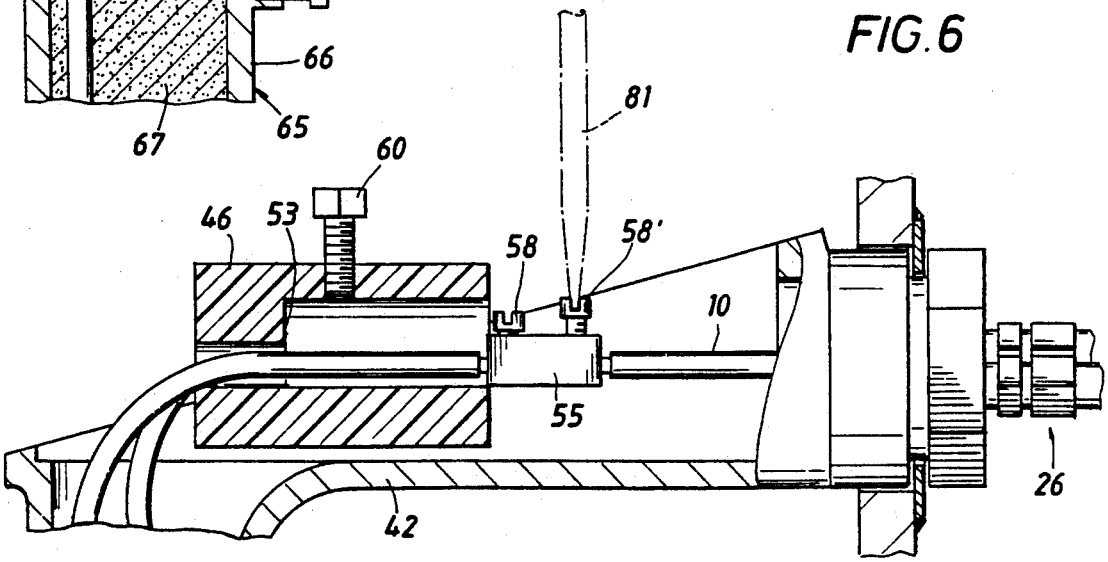

SEALED ELECTRICAL CONDUCTOR METHOD AND ARRANGEMENT FOR USE WITH A WELL BORE IN HAZARDOUS AREAS

STATEMENT OF THE PRIOR ART

Substantial difficulty has heretofore been encountered in providing a sealed arrangement for supplying electrical power to a sealed wellhead over a petroleum producing well bore in a hazardous area where explosions or fires may occur due to gases and other substances associated with the production of petroleum products being ignited by electric arcs. Also, personnel and the general public are subject to electrical shock or death by electrocution.

So far as known to applicant, there has not heretofore been provided a satisfactory and safe method and arrangement for supplying electrical power through power source electrical conductor means to downhole electrical conductor means extending through a sealed barrier associated with a wellhead associated with a well bore in a hazardous area to overcome the above and other problems.

Present commonly employed electrical installations for supplying electrical power through the wellhead and into the well bore for various purposes typically consist of a flexible corrugated downhole electrical conductor means extending through the wellhead which are connected externally of the well bore with the power source electrical conductor means. It is substantially difficult, if not impossible, to initiate and/or maintain an effective seal with the corrugated cable as it passes through the wellhead to prevent discharge of fluids in the hazardous area. The internal elements of the electrical cable are also subject to transmitting well bore liquids and gases therethrough. The gases and liquids pass through the electrical conductor means to an electrical enclosure in an adjacent non-hazardous area which creates another hazardous area. Arcing in the enclosure can cause an explosive situation. From this point, the power source electrical conductor means continues from ground level to the level of the power transformer. Such outdoor electrical installation is not in compliance with commonly accepted electrical practices and requirements, whether such installations occur in a hazardous or in a non-hazardous location.

Designs previously and currently in use fail to overcome the problems presented by the above installations. Both previous and current products employ the use of an attachment plug and receptacle, which constitutes a means by which the device being powered can be disconnected while power continues to be supplied to the power source electrical conductor means. The attachment plug and receptacle constitute disconnecting means which requires that the attachment plug and receptacle be rated for the same horsepower as the device to which power is being supplied. So far as known to applicant, no such rating is possible, especially since such plug and receptacle should also be capable of withstanding an internal explosion without spreading such explosion.

SUMMARY OF THE PRESENT INVENTION

An object of the present invention is to overcome the problems presented by prior devices and electrical arrangements used in hazardous areas.

An object of the present invention is to provide a relatively simple method and arrangement for supplying electrical power through power source electrical conductor means and connecting such electrical conductor means with the downhole electrical conductor means associated with a wellhead in a hazardous area for supplying electrical power into a well bore for various purposes, by way of example only, such as a downhole electrical pump, instruments and other downhole equipment.

Another object of the invention is to provide a splicing and conduit arrangement which safely conducts power to downhole electrical conductor means extending through a sealed barrier in a sealed wellhead that is positioned in a hazardous area subject to explosions and fires.

Another object of the present invention is to provide a rigid conduit including a splice fitting whereby a splice may be formed which separates the downhole electrical conductor means of a well bore power cable from the power source electrical conductor means and seal means in the rigid conduit means between the splice fitting and the rigid conduit with breather vent means so as to inhibit the passage of fluids from the downhole electrical conductor means to the power source electrical conductor means.

Another object of the present invention is to provide an arrangement for securing a power source electrical conductor means adjacent a well-head for supplying power to downhole electrical conductor means that extend into a sealed barrier associated with the wellhead which inhibits explosions and fires in the hazardous area.

A further object of the present invention is to provide an arrangement for supplying electrical power from a power source electrical conductor means in a rigid conduit which may be secured adjacent the wellhead and which is arranged so that the rigid conduit and electrical conductor means therein may be disconnected from the wellhead and removed from the wellhead outside the hazardous area.

Other objects and advantages of the present invention will become more readily apparent from a consideration of the following description and drawings.

BRIEF DESCRIPTION OF THE DRAWINGS

FIG. 4 is a top plan view of one form of splice fitting, with the cover removed, which may be employed to receive a formed splice which connects power source electrical conductor means with downhole electrical conductor means in a hazardous area where the present invention is employed;

FIG. 5 is a side sectional view, partly in elevation, showing a splice completed in the splice fitting of FIG. 4 with a cover thereon;

FIG. 6 is a side sectional view similar to FIG. 5 with the cap or cover of the splice fitting removed and illustrating the position of the splice before it is completed and positioned as illustrated in FIGS. 4 and 5.

DESCRIPTION OF THE PREFERRED EMBODIMENTS

Figure 3:
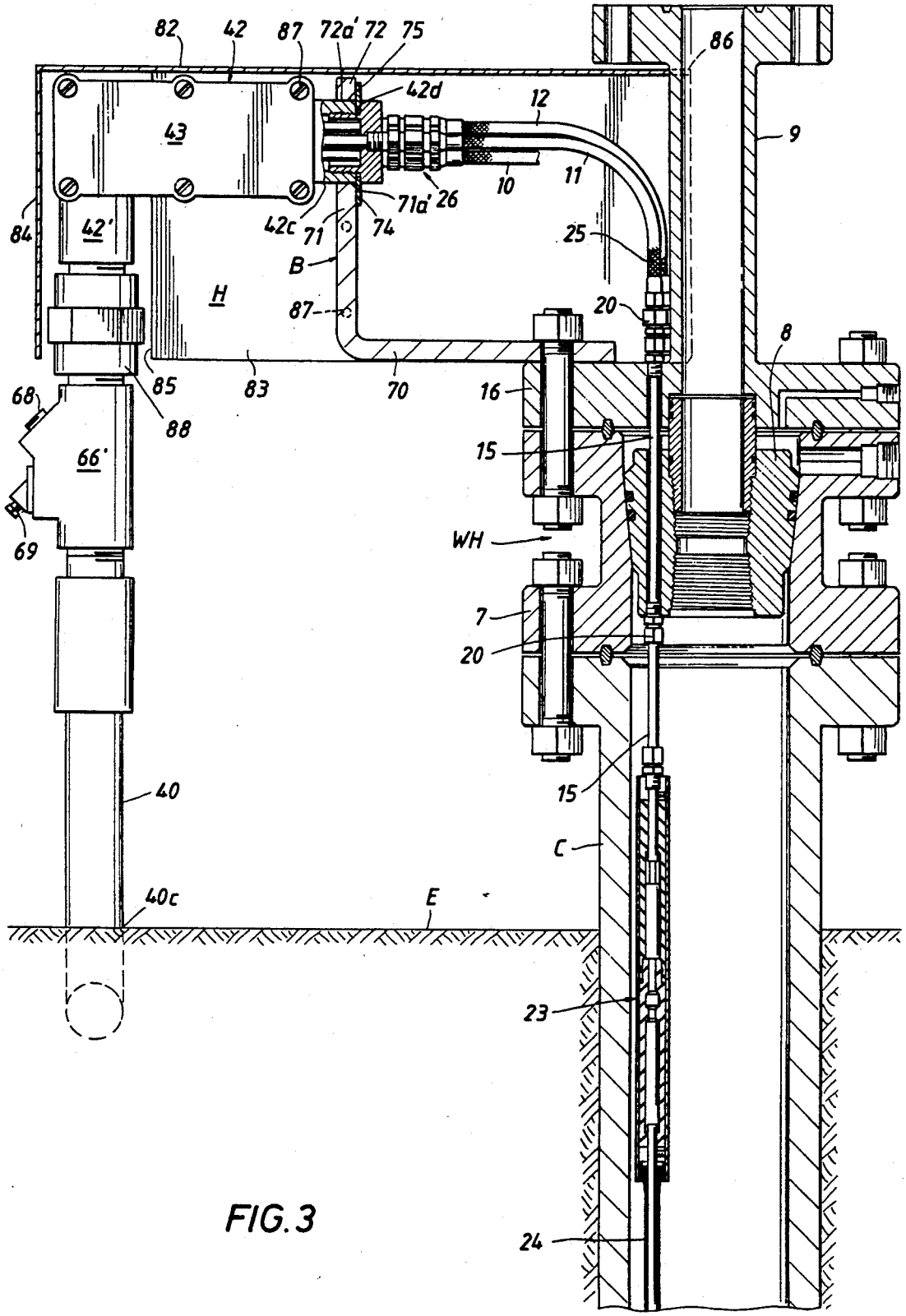
FIG. 3 is a sectional view partly in elevation on the line 3—3 of FIG. 1.

Attention is first directed to FIG. 3 of the drawings wherein a wellhead arrangement is referred to generally by the letters WH. Wellheads may assume various forms and configuration but generally include some type of member such as by way of example a tubing spool 7 secured by suitable means such as bolts as shown to the casing C which projects upward from the earth E which creates a hazardous area. A tubing hanger 8 may be positioned within the bore of the tubing spool 7 as shown in the drawings for supporting a tubing (not shown) which extends downwardly into the well bore through which the well fluids are conducted from the producing formation(s) in the well bore to the earth's surface. An adapter spool 9 is illustrated as positioned on top of the tubing spool and is adapted to receive a master control valve (not shown) on the top thereof for use in a manner well known in the art.

It can be appreciated that the wellhead configuration and components may change from that illustrated in FIG. 3 which is given by way of example only. Regardless of the configuration and components of a wellhead, the present invention may be employed to connect power source electrical conductor means with downhole electrical conductor means which sealably extends through the wellhead.

The tubing hanger forms a barrier in the wellhead through which electrical conductor means must extend for connection with an external power source to supply power as may be desired to an instrument, down-hole pump or other device.

The power source electrical conductor means and the downhole electrical conductor means may be of any well known type, such as by way of example only, each may comprise multiple separate electrical conductors where each electrical conductor is insulated and all the multiple electrical conductors enclosed or encased in a sheath or outer protective jacket. The power source and downhole electrical conductor means may each consist of a single conductor in a sheath or other protective cover.

The present invention will be described in detail as employing separate multiple electrical conductor means, but as noted this is by way of example only.

As illustrated in FIG. 3, the downhole electrical conductor means for a well bore cable is shown as having separate electrical conductor means 10, 11 and 12. As shown in FIG. 3, these separate electrical conductor means extend through the tubing hanger, and each is enclosed within a separate rigid tube means each of which tube means may be designated 15 which rigid tube means sealably extends through the tubing hanger and the lower annular flange 16 of adapter spool 9 which forms one type of sealed barrier for the wellhead WH.

Each of the rigid tube means 15 is preferably formed of material considered to be non-magnetic such as by way of example only, stainless steel, which is resistant to attack by fluids in the well bore or in the surrounding hazardous zone. Each tube means 15 is sealably secured by suitable rigid seal means 20 in the wellhead. The rigid seal means 20, 26 may be any suitable well known rigid seal means such as swagelok or the like which are available over the counter and which are corrosive resistant and considered to be non-magnetic may be employed.

Upper rigid seal means designated 20 sealably secure said rigid tube means 15 with the flange 16 and also sealably secure one end of the conduit portion 25 with the wellhead WH and/or the rigid tube means 15. Rigid seal means 26 secure the other end of the conduit portion 25 with the splice fitting 42. Additional or lower rigid seal means 20 sealably secures the rigid tube means 15 in the tubing hanger 8 and preferably adjacent the lower end thereof, but this position may be changed, if desired.

Figure 7:
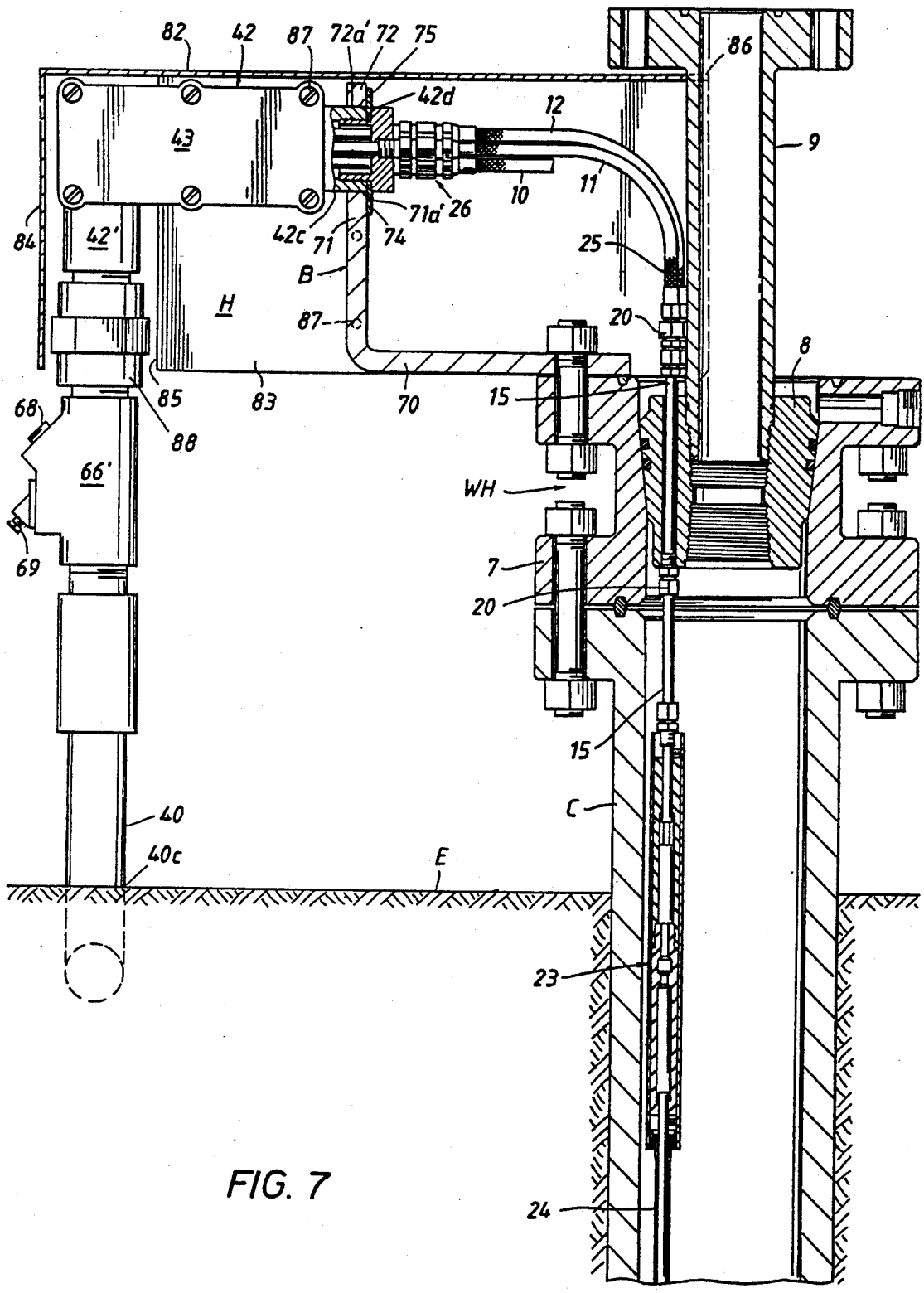
FIG. 7 is a view similar to FIG. 6 showing an alternate form of the barrier for the wellhead.

The barrier is illustrated in FIG. 3 as comprising the tubing hanger 8 and flange 16. It may be varied by way of example, to comprise only the tubing hanger 8 or flange 16.

Where the barrier in the wellhead consists of only the tubing hanger 8 as shown in FIG. 7, a single rigid seal means may be employed under some conditions to secure rigid tube means 15 with the hanger 8 but it is preferred that the upper and lower rigid seal means 20 each be positioned as shown in FIG. 7 to sealably secure said rigid tube means 15 with the hanger.

Should the annular flange 16 be employed as the barrier then the rigid seal means 20 may be connected at a single location to sealably secure the rigid tube means 15 passing therethrough, or to same double rigid seal means 20 arrangement described above when the tubing hanger serves as the barrier may be employed to sealably secure with the flange 16 and the rigid tube means 15. It can be appreciated that the location of the rigid seal means 20 in any situation may be varied to accomplish the desired sealing effect with the hanger 8 and/or the flange 16.

Regardless of the form of barrier, the conduit portion 25 is sealably secured therewith as described above.

In the embodiment illustrated in FIG. 3, the downhole electrical conductor means 10, 11, 12 are each further protected by the rigid tubes 15 which surround each of the electrical conductor means from the sealing tube fitting 20 at the lower end of the tubing hanger 8 and each rigid tube means extends to a separate connector represented generally by the numeral 23 wherein the three downhole separate electrical conductor means of the well bore power cable are each connected with one of the separate connectors 23. Suitable protection means such as flexible or rigid tube means forming conductor extensions 24 separately surround each of the electrical conductor means and depend or extend downwardly in the well bore to terminate adjacent the protective jacket on the power cable which jacket receives and encloses all three electrical conductor means therein. The rigid means 20, 26 employed provide a metal to metal seal between the components.

It can be appreciated that the wellhead and tubing hanger are provided with suitable seals as illustrated in FIG. 3 for inhibiting the flow of fluid therefrom in a undesired manner.

Where the downhole electrical conductor means comprise separate insulated electrical conductor means 10, 11, 12 as shown in FIG. 3 each may be received in a separate conduit portion 25, which as previously noted, is rigidly and sealably secured at one end by the rigid seal means 20 to the wellhead 20 and at its other end by the rigid seal means 26. Where the downhole electrical conductor means consists of a plurality of separate insulated electrical conductor means enclosed in a sheath or a single electrical conductor means in a sheath which extends through the wellhead, then there is only a single conduit portion 25 sealably secured adjacent the barrier and adjacent splice fitting 42 by rigid seal means 26. The rigid means 26 is preferably a swivel nut swagelok fitting to enable the arrangement of the present invention to be more readily disconnected from the wellhead as will be described herein. The conduit portion(s) 25 may be flexible or rigid of any suitable type to withstand the conditions under which they will be employed and to safely supply the power from the power source electrical conductor means to the downhole electrical conductor means of the power cable extending downwardly in the well bore (not shown). The conduit portion(s) 25 should be capable of withstanding a minimum of 600 psi internal test pressure and are preferably formed of Monel 400 which is considered to be non-magnetic and which will withstand the corrosive conditions to which the flexible electrical conduits may be subjected. Any other suitable flexible or rigid material which is corrosive resistant and considered non-magnetic and capable of withstanding 600 psi internal test pressure may be used. The conduit portion(s) may be obtained from any suitable source and is an over the counter type of the product with one form including a metal internal bellows surrounded by wire braid. The rigid seal means 20 and 26 which connect the flexible conduits and the single electrical conductor in each of said flexible conduits to the top of the wellhead and the rigid seal means 26 may be of any suitable type available on the market such as swagelok as previously noted.

Figure 2:
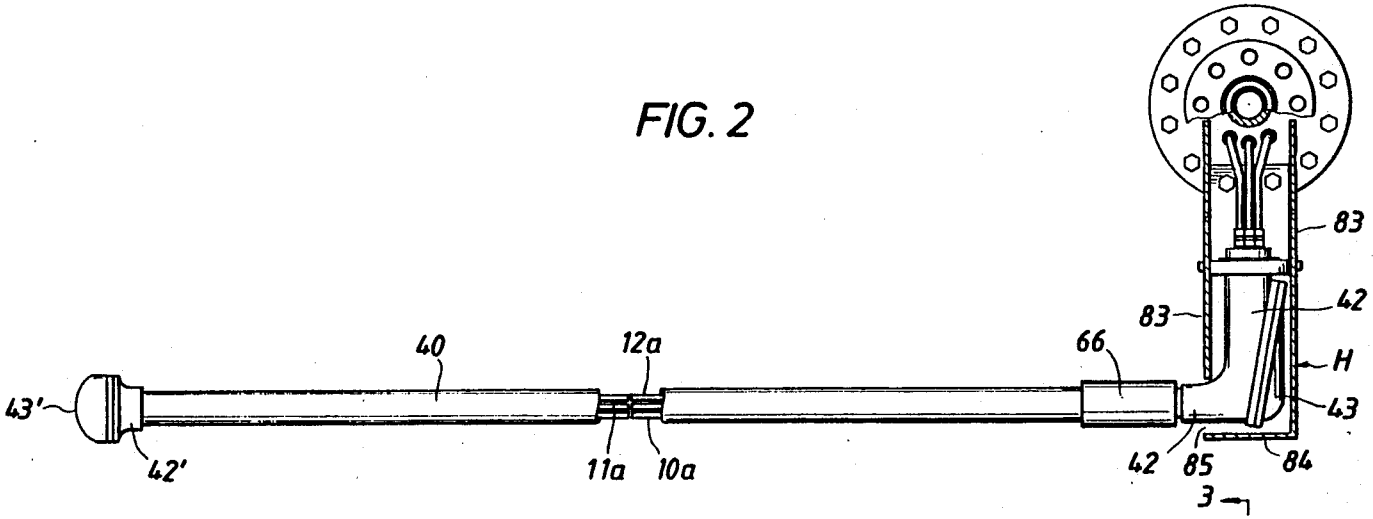
FIG. 2 is a top view looking down on FIG. 1.
Figure 1:
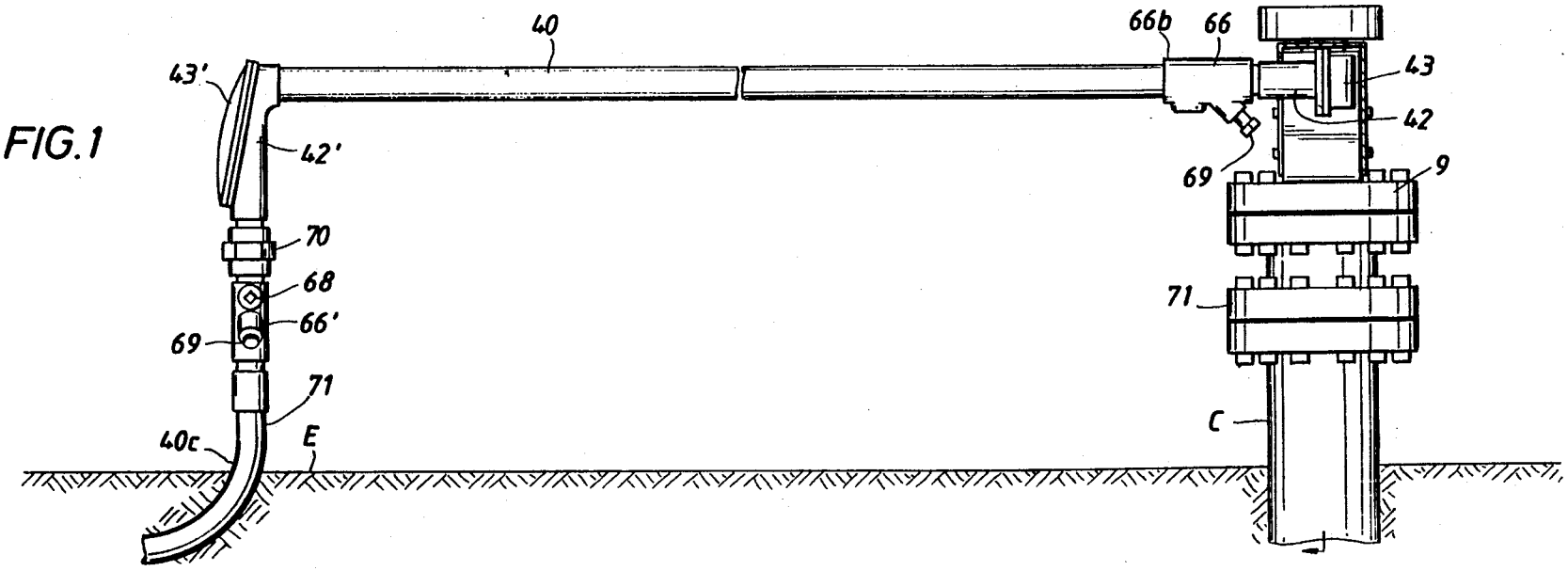
FIG. 1 is a side view of one preferred form of the present invention.

Rigid conduit means or pipe formed of suitable material, preferably metal is illustrated at 40 in FIG. 1 for receiving power source electrical conductor means which extend from a suitable power source (not shown) to adjacent the wellhead in what may be termed a hazardous area adjacent the well in which the wellhead is positioned. It can be appreciated that the rigid conduit or tubular member 40 extends from what may be termed a non-hazardous area where the power source is located into the area designated hazardous adjacent or around the wellhead. The end of the rigid conduit 40 immediately adjacent the wellhead is provided with a splice fitting 42 provided with a removable cap or cover 43 for gaining access thereto to splice the downhole electrical conductor means with the power source electrical conductor means. Where the downhole electrical conductor means is as illustrated at 10, 11 and 12 they each will be spliced with one of the power electrical conductor means 10*a*, 11*a* and 12*a* extending from the rigid conduit 40 to the splice fitting 42. The splice fitting 42 may be of any suitable well known and accepted type which is sold over the counter, such as the Crouse-Hinds Catalog No. LBH70.

Means for forming a splice is provided for positioning within the splice fitting 42 as shown in FIGS. 4–6 inclusive. Such means includes an insulating member 46 of any suitable electrical insulating material which provides as much and preferably more electrical insulation than that of the electrical insulation of the conductors to be spliced, such as delrin. Where the power source and downhole electric conductor means consist of separate electric conductor means, then separate passages of the same number as the electrical conductor means will be provided in insulating member 46. In the embodiment shown in FIGS. 4–6, three separate passages 47, 48 and 49 extend through the member 46 to receive 10, 11, 12 and 10*a*, 11*a*, 12*a* as shown in FIG. 4. The passages 47, 48 and 49 which extend from the one end 50 and into the member 46 are of less lateral extent than the portion of each passage which extends inwardly from the other end 51 of the member 46 as shown in FIG. 5. The juncture of the enlarged passage portions extending from the end 51 with the smaller passages extending from the end 50 of the member 46 provide a shoulder 53 as shown. The passages 47, 48 and 49 communicating with the end 50 each receive therein one of the power source electrical conductor means 10*a*, 11*a*, 12*a* extending through rigid conduit means 40 from the cable that encloses them and connects with a suitable power source (not shown) as illustrated in FIG. 4. The conductor element or portion of each of the power source electrical conducting means is exposed as shown at 10*a*', 11*a*' and 12*a*' respectively. Separate splice connectors 55 are shown, each of which has a passage which extends partially from one end of each connector for receiving the exposed portions 10*a*', 11*a*' and 12*a*' of each of the power source electrical conducting means and each splice connector 55 is provided with suitable means such as a screw 58 for securing each of the exposed elements of each of the electrical conductor means in one end of the electrical conductor splice connector 55.

Similarly, the exposed conductor element portion 10', 11' and 12' of each of the downhole electrical conductor means 10, 11 and 12 is exposed as shown in FIGS. 4 and 5 and each extends into a passage extending into the other end of each electrical conductor splice connector 55 and is secured therewith by a screw 58' or the like.

The member 46 may then be moved to a desired position within the splice fitting 42 and the cables 10, 11, 12 and 10*a*, 11*a*, 12*a* positioned so that if desired one end of the member 46 may abut the shoulder 53 as shown in FIG. 5. An insulating screw 60 formed of plastic or the like may be positioned between the two longitudinally spaced screws 58 and 58' on the center member 55 to retain the splice connectors 55 in position as desired within the insulating member 46. If desired, additional insulating screws may be positioned in member 46 to abut the end of each splice connector 55 which is adjacent the outer splice connector 55 nearest the end 51 of member 46.

To assure that the present invention will function within the hazardous area as desired, it is preferable in most instances, that a seal means represented by the numeral 65 be provided in the conduit downstream of the splice fitting 42 adjacent the wellhead in which the plural electrical conductors of thepower source are spliced with the multiple electrical conductors of the downhole power cable as previously described.

The seal means 65 is downstream from the wellhead and comprises a seal fitting 66 with a sealant 67 therein. The sealant 67 is preferably and should be obtained from the manufacturer of the seal fitting. For example, in the present instance the seal fitting is catalogue No. EYD6, used as one off the shelf example of a suitable fitting which may be employed and is manufactured by Crouse-Hinds and the seal compound or sealing means of Crouse-Hinds should be employed with that fitting. Where a seal fitting of another manufacturer is employed, then that manufacturer's seal means including its sealant compound is employed.

Particular means of Crouse-Hinds for the specific seal fitting above designated, comprises a compound and a fiber. Crouse-Hinds refers to its sealant compound as Chico A and the fiber is referred to as Chico X. To form the seal means 65, the seal fitting 66 may be provided with the sealing 67 prior to or after its connection with the nipple 31 which is connected to the end 42*a* of splice fitting 42. In either situation the Chico X fiber is stuffed in the fitting 66 and then Chico A compound is mixed with water in accordance with the manufacturer's instructions and then poured into the seal fitting on top of the fiber. The thickness, or longitudinal extent of the sealant 67 formed within a seal fitting must at least be equal in longitudinal length to the diameter of the fitting member in which it is positioned. It is recommended that the minimum diameter of the conduit or tubular member for receiving the plural electrical power conductors from the power source and various fittings employed herein have a minimum diameter of 2 inches, then the minimum longitudinal extent of the seal fitting 66 should be not less than 2 inches. As better seen in FIGS. 5 and 6, a nipple 31 is connected between the seal fitting 66 and the end 42*a* of splice fitting 42. Where the seal fitting 66 is secured in position between nipple 31 and conduit 40, the sealant 67 is formed therein by inserting Chico X and Chico A and then adding Chico A compound as described above. The seal fitting 66 includes the plug 68 and breather 69 as best illustrated in FIGS. 1 and 3 with another seal fitting 66' shown connected in the downward extension of conduit 40 outside the hazardous area as shown in FIG. 1, and the sealant may be formed by removing plug 68 and then repositioning the plug in the seal fitting after the sealant is formed in the fitting. The sealant 67 is formed within the seal fitting 66 and is within 18 inches from the adjacent splice fitting 42.

In the preferred embodiment illustrated, such female seal fitting 66 is for sealing in a vertical or a horizontal position and is preferably by way of example only, the EYD6 of Crouse-Hinds, as previously noted. It can be appreciated that other conduit seal fittings, vertical or horizontal, male and female, elbow seal, female hubs, male and female hub may be employed in certain situations.

The seal fitting 66 shown in FIG. 3 is connected at its end 66*b* to the conduit 40, and also includes a plug 68. A breather or vent 69 in the seal fitting 66 is between the sealant and the wellhead in the drawings. Seal fittings 66 and 66' are preferably the same. Seal fitting 66 is connected in the conduit 40 and then connects with splice fitting 42 which in the preferred embodiment is adjacent the wellhead in the hazardous area. Seal fitting 66' is connected in conduit 40 outside the hazardous area.

The seal means 65 including seal fitting 66, sealant 67 and breather tube or vent means 69 are for allowing an internal explosion to occur therein and in the arrangement in a hazardous situation without conveying the explosion internally of the conduit 40 or externally thereof. Also, it accommodates a flame or fire within such confinement, without permitting or conveying the flame externally. The breather vent is constructed in a well known manner to contain internal explosions and fires or flames within the arrangement. In addition to the foregoing the breather tube 69 aids in discharging fluids, liquids and gases from the seal fitting 66. In this regard, it should be noted also that the sealing compound used in conduit seal fittings is somewhat porous so that gases, particularly those under slight pressure with small molecules such as hydrogen may pass slowly through the sealing compound. Also, it should be noted that there is no gasket between the splice fitting 42 and the cover 43 to permit the discharge of fluids from the splice fitting 42 to the surrounding atmosphere. If any gas or fluid should migrate through the insulation of the electrical conductors 10, 11 and 12 between the wellhead and the splice fitting, gas is permitted to escape through the conduit seal fitting 66 through the breather 69, as noted previously.

Also, the arrangement and configuration of the splice within the splice fitting 42 does not directly connect or join the two sets of cables in engagement together and thereby isolates the multiple conductors of the power cable from the plural conductors of the power source to further inhibit movement of gas and/or liquids from the well bore through the conduit 40 and the electrical conductors.

The rigid conduit means 40 may extend from the wellhead in an elevated relationship as illustrated and then the portion thereof as shown in FIG. 1 depends downwardly into the earth represented by the letter E at a location as illustrated at 40*c* in FIGS. 1 and 3 beyond the portion or area classified as hazardous. Another splice fitting 42' may be provided and a splice formed therein in the manner as described and illustrated with regard to FIGS. 4, 5 and 6 herein to connect electrical conductors from a power source with the plural electrical conductors in rigid conduit means 40. In this situation a union 88 may be threadedly connected with the end of the splice fitting 66' as indicated and also connected with the seal fitting 66' therebeneath. The seal fitting 66' is connected in turn to an elbow 71 that extends into the ground at the location outside the hazardous area. The splice fitting 42' is also preferably provided within 18 inches of seal fitting 66' as previously described with regard to splice fitting 42.

Suitable support means are provided for securing or locking the splice fitting 42 and conduit means 40 in position adjacent the wellhead and such means includes a bracket represented by the letter B with a portion 70 secured to the wellhead in any suitable manner such as by the bolt and nut means as illustrated in FIG. 3 of the drawings. The bracket B has a lower upwardly extending portion 71 and a separate upper portion 72 for connection with the lower upwardly extending portion 71. The top edge of lower portion 71 and the bottom edge of the upper portion 72 are each provided with matching semi-circular recess 71*a*', 72*a*' to receive the end 42*c* of splice fitting 42 there through as shown in FIG. 3 of the drawings. Suitable bolts (not shown) may then be secured through the upper portion 72 to extend into the lower 71 to secure the bracket in position with the splice connected as shown in FIG. 3.

In the embodiment illustrated, suitable means are provided to lock the splice fitting 42 to or adjacent the bracket B and to the wellhead. Such means may assume any form and as illustrated includes the semi-circular rings 74 and 75 on the lower and upper upwardly extending portions 71, 72 respectively which rings project beyond the semi-circular recess defined by the mating lower and upper bracket portions 71, 72. The rings 74, 75 extend into a groove 42*d* formed in the splice fitting and thereby lock the splice fitting and bracket to the wellhead.

In another form, the securing means may be in the form of a nipple that is threaded into the end 42*c* of the splice fitting 42 and is provided with an end that is threaded externally and which projects through a circular opening in a bracket portion which extends upwardly from the portion 70 to receive the end 42*c* of the fitting therethrough. The threaded nipple end projects through the opening in the upstanding bracket portion receives a threaded ring thereon that abuts the upstanding bracket portion to secure the splice fitting 42 in position adjacent the wellhead.

In FIG. 6 any suitable instrument such as a screwdriver 81 may be employed to secure the screws 58, 58' of each of the splice connectors 55 with the respective conduit exposed ends of the plural conductors of the power cable and the multiple conductors of the downhole cable.

A suitable housing H is provided to enclose the splice fitting 42 adjacent the wellhead to inhibit fluid such as water and the like from entering thereinto. Such housing as shown in FIG. 3 includes a top wall 82, side walls 83 and an end wall 84 as shown. It will be noted that the top cover 82 of the housing H is provided with a cut away portion represented at 86 in FIG. 3 so that the housing fits snugly adjacent a portion of the spool 9 as illustrated. One of the side walls such as the wall 83 is provided with an opening 85 to enable the splice connector 42 to extend therethrough for communication with the conduit 40. The housing H is secured to the bracket B by non-tamper screws or nuts represented at 87 in dotted line. Similarly, the covers 43 for the splice fittings 42', 42' are maintained in position by non-tamper means 87 well known in the art to inhibit access, except with special tools. This effectively locks the housing H and caps 43, 43' in place so that access can be gained only by authorized personnel. The splice fitting 42' outside the hazardous area connects the horizontal portion of the conduit means 40 with the vertical portion thereof as shown, and as previously noted, a splice is formed therein in the manner as described with regard to the splice fitting 42.

The present invention is advantageous in that it provides an arrangement so that the power source electrical conducting means which supply power to the wellhead are maintained in a conduit, which conduit can be easily moved out of the way or disconnected from the wellhead when desired.

To effect such disconnection and/or removal, the splice in the splice fitting 42 immediately adjacent the wellhead is disconnected by reversing the splicing procedure previously described and the splice fitting 42 is unlocked from the bracket B. The union 88 may be rotated whereupon the conduit means 40 with the power cable therein can be rotated sufficiently to displace it from the wellhead. At the same time as the splice in fitting 42 is disconnected or thereafter, the splice in the splice fitting 42 may be disconnected and the union disconnected from the splice fitting so that the entire horizontally extending rigid conduit means 40 may be removed to a remote location while wellhead operations are conducted.

In the preferred embodiment the conduit means 40 extends from its connection with the wellhead in horizontal elevated plane or position above the earth as shown.

Where the downhole electrical conductor means is a single large member, an offset tubing hanger may be required to accommodate passage of such conductor therethrough. Also, it can be appreciated that the conduit portion 25 may be formed by extending rigid tube means 15, or by a separate conduit portion connecting directly into the passage(s) in the barrier for communicating with the rigid tube means sealably secured therein. It can be further understood that the connector arrangement 24 can be modified to provide a single connector where the downhole electrical conductor means is a single member. Preferably the outer jacket and any other coverings of the power source electrical conductor means should be removed so that the sealing compound, or sealant 67, in seal fitting 66 will surround each individual insulated conductor and the outer jacket.

The foregoing disclosure and description of the invention are illustrative and explanatory thereof, and various changes in size, shape and materials as well as in the details of the illustrated construction may be made without departing from the spirit of the invention.

What is claimed is:

1. An arrangement to conduct electrical power from a non-hazardous area through power source electrical conductor means to downhole electrical conductor means wherein the downhole electrical conductor means extends through a barrier in a wellhead in a hazardous area comprising:

rigid tube means enclosing the downhole electrical conductor means extending through the barrier;

a splice fitting adjacent the wellhead for providing an enclosure to receive the power source electrical conductor means and downhole electrical conductor means therein;

a conduit portion extending from the barrier to said splice fitting and enclosing the downhole electrical conductor means; and rigid seal means sealably engaging said conduit portion with the barrier and with said splice fitting.

2. The arrangement of claim 1 including:

a rigid conduit for receiving the power source electrical conductor means;

a seal fitting for connecting between said rigid conduit and said splice fitting; and vent means in said seal fitting to accommodate fluid escape from the arrangement.

3. The arrangement of claim 2 including means for forming a splice to electrically connect the power source electrical conductor means with the downhole electrical conductor means within said splice fitting and seal means in said seal fitting within 18 inches of said splice fitting.

4. The arrangement of claim 1 wherein the barrier is an annular flange secured with the wellhead with said rigid tube means extending through the annular flange.

5. The arrangement of claim 1 wherein the barrier comprises an annular flange and a tubing hanger with said rigid tube means extending through said annular flange and tubing hanger and additional rigid seal means to sealably secure said rigid tube means with said tubing hanger below said rigid seal means which sealably engages with said conduit portion.

6. The arrangement of claim 1 wherein the barrier is a tubing hanger and additional rigid seal means to sealably secure said tube means with said tubing hanger below said rigid seal means which sealably engages with said conduit portion.

7. The arrangement of claim 1 wherein the power source electrical conductor means and the downhole electrical conductor means each comprise a single conductor in an outer jacket or multiple conductors in an outer jacket.

8. The arrangement of claim 1 wherein said conduit portion is flexible and capable of withstanding 600 psi internal test pressure.

9. The arrangement of claim 1 including:

a housing secured adjacent said wellhead to cover said splice fitting secured adjacent thereto.

10. The arrangement of claim 1 including rigid conduit means for receiving the power source electrical conductor means therethrough and means for removably connecting said rigid conduit means adjacent said wellhead; and wherein said rigid conduit means extends continously from said splice fitting without any ohter splice fittings therein within the hazardous area;

said rigid conduit means extends to an area designated nonhazardous before other splice fittings are secured in said conduit;

said rigid conduit means extends into the earth at a location outside the hazardous area; and wherein said rigid conduit means includes a union therein whereby said rigid conduit means may be rotated away from the wellhead when said rigid conduit means is disconnected from adjacent said wellhead.

11. The arrangement of claim 1 including:

an insulating member for said splice fitting having opening means therethrough for receiving in one end thereof the power source electrical conductor means and in the other end the downhole electrical conductor means;

splice connector means for electrically connecting said power source electrical conductor means and said downhole electrical conductor means;

spaced first and second means for securing said power source electrical conductor means and said downhole electrical conductor means with said splice connector means;

insulating means removably secured in said insulating member and positoned between said first and second means for aiding in maintaining said splice connector means connected with said power source electrical conductor means and said downhole electrical conductor means within said insulating member; and wherein the opening means in said insulating member adjacent one end thereof are greater in lateral extent than the opening means are at the other end of said insulating member.

12. The arrangement of claim 11 wherein said opening means in said insulating member comprises a plurality of openings therethrough for receiving multiple power source electrical conductor means in one end of the openings and multiple downhole electrical conductor means in the other end of the openings.

13. A method of positioning an arrangement to conduct electrical power from a non-hazardous area through power source electrical conductor means to downhole electrical conductor means wherein the downhole electrical conductor means extends through a barrier in a well head in a hazardous area comprising:

extending downhole electrical conductor means with rigid tube means thereon through the barrier;

positioning rigid seal means to sealably secure the downhole electrical conductor means with the barrier;

supporting a splice fitting adjacent the well head for providing an enclosure to receive the downhole electrical conductor means therein;

enclosing the downhole electrical conductor means with a conduit portion which extends from the barrier to the splice fitting; and positioning rigid seal means to sealably engage the conduit portion with the barrier and with the splice fitting.

14. The method of claim 13 including the steps of:

extending power source electrical conductor means through rigid conduit means from a non-hazardous area to the hazardous area;

securing a seal fitting with a vent therein between the rigid conduit means and the splice fitting;

splicing together the power source electrical conductor means and the downhole electrical conductor means for enclosing the splice fitting; and providing a seal in the seal fitting within 18 inches of the splice fitting.

15. In an arrangement to conduct electrical power from a non-hazardous area through power source electrical conductor means to downhole electrical conductor means wherein the downhole conductor means extend through a barrier in a wellhead in a hazardous area including:

rigid conduit means extending into the hazardous area from an adjacent non-hazardous area with the power source electrical conductor means therein for conducting electrical power to the downhole electrical conductor means;

first seal fitting means on said rigid conduit means within the hazardous area, said seal fitting means having a vent therein;

first splice fitting means connected to said first seal fitting means adjacent the wellhead for receiving the ends of said power source electrical conductor means and the ends of said downhole electrical conductor means therein for splicing them together;

second splice fitting means connected to said rigid conduit means outside the hazardous area for receiving therein the ends of an electric conductor from a power source and the ends power source electrical conductor means in said rigid conduit means for splicing them together;

second seal fitting means connected to said second splice fitting means, said seal fitting means having a vent therein; and each said first and second seal fitting means having seal means therein within eighteen inches, respectively, of said first and second splice fitting means.

16. The arrangement of claim 15 including means to removably connect the arrangement adjacent the wellhead.

17. The arrangement of claim 16 wherein said rigid conduit means includes a portion that extends into the earth outside the hazardous area and a union in said portion to permit said rigid conduit means to be disconnected from said conduit portion and from adjacent the wellhead after the splice between said power source and downhole electrical conductor means in said first and second splice fittings have been disconnected.

* * * * *